US007063502B2

(12) United States Patent
Honda et al.

(10) Patent No.: US 7,063,502 B2
(45) Date of Patent: Jun. 20, 2006

(54) FUEL PUMP

(75) Inventors: Yoshihiko Honda, Obu (JP); Kazumichi Hanai, Obu (JP)

(73) Assignee: Aisan Kogyo Kabushiki Kaisha, Obu (JP)

( * ) Notice: Subject to any disclaimer, the term of this patent is extended or adjusted under 35 U.S.C. 154(b) by 25 days.

(21) Appl. No.: 10/808,638

(22) Filed: Mar. 25, 2004

(65) Prior Publication Data

US 2004/0191054 A1 Sep. 30, 2004

(30) Foreign Application Priority Data

Mar. 27, 2003 (JP) ..... 2003-088857

(51) Int. Cl.
*F04D 29/42* (2006.01)

(52) U.S. Cl. ..... 415/55.2; 415/55.5; 415/225; 415/226

(58) Field of Classification Search ..... 415/55.1, 415/55.2, 55.3, 55.4, 55.5, 55.6, 55.7, 225, 415/226

See application file for complete search history.

(56) References Cited

U.S. PATENT DOCUMENTS 4,478,550 A * 10/1984 Watanabe et al. ..... 415/55.2

FOREIGN PATENT DOCUMENTS

| | | |
|---|---|---|
| EP | 1 158 172 | 11/2001 |
| EP | 1 447 554 | 8/2004 |
| JP | 01-177492 | 7/1989 |
| WO | WO 990707990 | 2/1992 |

OTHER PUBLICATIONS

U.S. Appl. No. 10/851,732, unpublished, Masaki Ikeya.

* cited by examiner

*Primary Examiner*—Edward K. Look
*Assistant Examiner*—Dwayne J White
(74) *Attorney, Agent, or Firm*—Dennison, Schultz, Dougherty & MacDonald

(57) ABSTRACT

A fuel pump prevents pressurized fuel from being pulled into a clearance between an outer circumference face of an impeller and an inner circumference face of a pump case, thereby allowing the delivery of the pressurized fuel from a pump body side to a pump cover side through through-holes of the impeller.

Since a clearance C2 between an impeller outer circumference face 16*p* and a pump cover inner circumference face 39*c* is made extremely small, the pressurized fuel is caused to pass via through-holes 16*c* that communicate between an upper and an lower side of an impeller 16. By this means, it is difficult for the pressurized fuel to enter the clearance C2, and it is possible to prevent the decrease in pump efficiency caused by pressure at the impeller outer circumference face 16*p* and the vicinity thereof.

9 Claims, 13 Drawing Sheets

FUEL PUMP

CROSS REFERENCE

The present application claims priority based on Japanese Patent Application 2003-088857 filed on Mar. 27, 2003, and the contents of which are hereby incorporated by reference within this application.

FIELD OF THE INVENTION

The present invention relates to a fuel pump for drawing in a fuel such as gasoline etc., increasing the pressure thereof, and discharging the pressurized fuel.

BACKGROUND OF THE INVENTION

In a fuel pump known to the art, a substantially disc-shaped impeller is rotated within a casing, whereby fuel is drawn from outside the casing to within the casing, the pressure of the fuel is increased within the casing, and the pressurized fuel is discharged to the exterior of the casing. An example of this type of fuel pump is shown in FIGS. 10 to 14. FIG. 10 is a cross-sectional view of a conventional fuel pump, FIG. 11 is a figure, viewed from an inner side of the casing, of an impeller 16 in a fitted state within a pump cover 9, FIG. 12 is a figure, viewed from the inner side of the casing, of pump cover 9, FIG. 13 is a figure, viewed from the inner side of the casing, of a pump body 15, and FIG. 14 is a figure schematically showing the flow of fuel.

As shown in FIG. 10, the fuel pump comprises a pump portion 1 and a motor portion 2 for driving pump portion 1. Pump portion 1 and motor portion 2 are unified by a housing 4.

Pump portion 1 comprises a pump cover 9, a pump body 15, and a substantially disc-shaped impeller 16, etc. Pump cover 9 and pump body 15, by being fitted together, form a casing 17 wherein impeller 16 is housed.

As shown in FIG. 11, impeller 16 is substantially disc shaped, and a group of concavities 16*a* is formed in an area thereof inwards from an impeller outer circumference face 16*p* by a specified d distance, the group of concavities 16*a* being formed along a circumference direction thereof. Adjacent concavities 16*a* are separated by partition walls 16*d* that extend in a radial direction. Concavities 16*a* and partition walls 16*d* form the group of concavities 16*a* that are repeated in a circumference direction. The group of concavities 16*a* is formed in both upper and lower faces of impeller 16, and base portions of each of the upper and lower concavities 16*a* communicate via a through-hole 16*c* (see FIG. 14).

As shown in FIGS. 10 and 12, a groove 21 is formed in a lower face of pump cover 9 in an area opposite the group of concavities 16*a* in the upper face of impeller 16. Groove 21 extends continuously in the direction of rotation of impeller 16 from an upper flow end 21*a* to a lower flow end 21*c*. A discharge hole 24 is formed in pump cover 9, discharge hole 24 extending from lower flow end 21*c* of groove 21 to an upper face of pump cover 9. Discharge hole 24 passes through from the interior of casing 17 to the exterior of casing 17 (an inner space 2*a* of motor portion 2).

As shown in FIG. 11, an inner circumference face 9*c* of a circumference wall 9*b* of pump cover 9 faces impeller outer circumference face 16*p* with a minute clearance C2 being formed therebetween. Inner circumference face 9*c* extends along almost the entire circumference of pump cover 9 (the region shown by the angle A shown in FIG. 11 being excepted therefrom). Inner circumference face 9*c* protrudes outwards in the radial direction at the region shown by the angle A in the vicinity of discharge hole 24, thereby ensuring a large clearance C1 between inner circumference face 9*c* and impeller outer circumference face 16*p*.

As shown in FIGS. 11 and 12, groove 21, in the vicinity of lower flow end 21*c* thereof, extends in a tangential direction in a straight line to the radial outer side (see 21*b*), and discharge hole 24 protrudes further outwards than the group of concavities 16*a* of impeller 16. Discharge hole 24 also protrudes even further outwards than impeller outer circumference face 16*p*.

As shown in FIGS. 10 and 13, a groove 20 is formed in an upper face of pump body 15 in an area opposite the group of concavities 16*a* in the lower face of impeller 16. Groove 20 extends continuously along the direction of rotation of impeller 16 (in FIGS. 12 and 13 the figures are viewed from a reverse direction and consequently the direction of rotation of the impeller is shown facing the reverse direction) from an upper flow end 20*a* to a lower flow end 20*b*. An intake hole 22 is formed in pump body 15, intake hole 22 extending from upper flow end 20*a* of groove 20 to a lower face of pump body 15. Intake hole 22 passes through from the interior to the exterior of casing 17.

Groove 21 extending in the circumference direction of pump cover 9, and groove 20 extending in the circumference direction of pump body 15, extend along the direction of rotation of impeller 16, and extend from intake hole 22 to discharge hole 24. When impeller 16 rotates, the fuel is drawn into casing 17 from intake hole 22, flows from intake hole 22 along grooves 20 and 21 towards discharge hole 24, the pressure of the fuel rising meanwhile, and then the pressurized fuel is delivered from discharge hole 24 to motor portion 2.

Discharge hole 24 communicates with a clearance 26 between impeller outer circumference face 16*p* and inner circumference face 9*c* of pump cover 9 (see FIGS. 11 and 14). As shown in FIG. 14, the fuel that has been pressurized by impeller 16 within groove 20 flows into discharge hole 24 via clearance 26 at the outer side of impeller outer circumference face 16*p*.

SUMMARY OF THE INVENTION

The fuel that has flowed into the outer side of impeller outer circumference face 16*p* at clearance 26 is pulled by a rotation of impeller 16 into minute clearance C2 that is formed between impeller outer circumference face 16*p* and inner circumference face 9*c* of pump cover 9 (with the exception of the region shown by the angle A). When the pressurized fuel flows into minutes clearance C2, the fuel pressure at impeller outer circumference face 16*p* increases. The increased fuel pressure at impeller outer circumference face 16*p* increases a force of impeding the rotation of impeller 16, and the rotational efficiency of impeller 16 falls.

Further, as shown in FIG. 14, the fuel that was pressurized in groove 20 merges with the fuel that was pressurized in groove 21 at the location where the fuel pressurized in groove 20 passes to the upper side of impeller 16 via clearance 26. At this juncture, the fuel that was pressurized in groove 21 sometimes flows back (see the dotted line in the center of the figure) into clearance 26. The pressure of the pressurized fuel pulses at the frequency according to which concavities 16*a* pass discharge hole 24. This has the result that, at the location of merging, a state whereby the fuel pressurized in groove 20 has a higher pressure than the fuel pressurized in groove 21 repeatedly alternates with a state whereby the fuel pressurized in groove 21 has a higher pressure than the fuel pressurized in groove 20. As a result, the back flow of the fuel is intermittent. When the intermittent back flow occurs, a pulse noise is generated by the fuel pump.

One object of the present invention is to makes it difficult for the pressurized fuel to pass through to the outer side of the impeller outer circumference face. By this means, it becomes difficult for the pressurized fuel to flow into minute clearance C2 between impeller outer circumference face 16*p* and inner circumference face 9*c* of pump cover 9. The fuel pressure at impeller outer circumference face 16*p* is prevented from increasing, and consequently the rotational efficiency of impeller 16 is prevented from decreasing.

Another object of the present invention is that the fuel pressurized in one of the grooves does not merge with the fuel pressurized in the other groove after passing through the outer side of impeller outer circumference face 16*p*, and consequently the pulse noise generated by the fuel pump is reduced.

The fuel pump of the present invention is provided with a substantially disc-shaped impeller that rotates within a casing. A group of concavities is formed in the substantially disc-shaped impeller in an area inwards from an outer circumference of the impeller by a specified distance, the group of concavities being formed along a circumference direction of the impeller. Adjacent concavities are separated by partition walls extending in a radial direction. The group of concavities is formed in both upper and lower faces of the impeller. Base portions of the upper and lower concavities communicate. Further, grooves are formed in an area of an inner faces of the casing opposite the groups of concavities, the grooves extending continuously in the direction of rotation of the impeller from an upper flow end to a lower flow end respectively. An intake hole and a discharge hole are formed in the casing, the intake hole passing from the exterior of the casing to the upper flow end of one of the grooves, and the discharge hole passing from the lower flow end of the other of the grooves to the exterior of the casing. The groove located at a side opposite the discharge hole and sandwiching the impeller with the groove at a side of the discharge hole communicates with the discharge hole via through-holes communicating between the concavities in the upper and lower faces of the impeller. That is, the groove at the side opposite the discharge hole is not provided with a communication hole that communicates with the discharge hole via the outer side of the impeller outer circumference face. The groove at the side opposite the discharge hole instead communicates with the discharge hole only via the through-holes that communicate between the concavities in the upper and lower faces of the impeller.

In the conventional fuel pump, the fuel that was pressurized in the groove at the side opposite the discharge hole is guided to the discharge hole by passing through the clearance formed at the outer side of the impeller outer circumference face. When the pressurized fuel passes through the clearance formed at the outer side of the impeller outer circumference face, the fuel pressure exerted upon the impeller outer circumference face increases. When the fuel pressure increases, force of impeding the rotation of the impeller increases, and pump efficiency consequently falls.

In the pump of the present invention, it is difficult for the pressurized fuel to pass through to the outer side of the impeller outer circumference face. Consequently, it is difficult for the pressurized fuel to flow into minute clearance C2 between the impeller outer circumference face and the inner circumference face of the casing. As a result, the fuel pressure at the impeller outer circumference face is prevented from increasing, and consequently the rotational efficiency of the impeller is prevented from decreasing.

Further, the fuel pressurized in the groove at the side opposite the discharge hole does not merge with the fuel pressurized in the other groove after passing through the outer side of the impeller outer circumference face, and consequently the pulse noise generated by the fuel pump is reduced.

Furthermore, in the conventional fuel pump, the fuel pressure operating upon the impeller outer circumference face at clearance C2 differs from the fuel pressure operating upon the region of the angle A shown in FIG. 11. As a result, the problem can readily occur that a force in an upper left direction is exerted from the region of the angle A (at the bottom right in FIG. 11), this force being exerted on a bearing that supports a shaft causing the impeller to rotate, and causing localized abrasion. In the pump of the present invention, the fuel pressure exerted upon the impeller outer circumference face is identical along the entire circumference direction thereof, thereby preventing localized abrasion of the bearing.

It is preferred that the inner circumference face of the casing of the fuel pump faces the impeller outer circumference face along the entire circumference of the impeller, with a minute space therebetween.

The fuel pump of the present invention allows the clearance between the impeller outer circumference face and the inner circumference face of the casing to be constantly extremely small along the entire circumference of the impeller. This renders it difficult for the pressurized fuel to pass through to the outer side of the impeller outer circumference face when the fuel is to be delivered to the discharge hole from the groove that is located at the side opposite the discharge hole and that sandwiches the impeller with the groove at the side of the discharge hole. By adjusting the clearance between the impeller outer circumference face and the inner circumference face of the casing to have a constant extreme smallness along the entire circumference of the impeller, the fuel pressure exerted upon the impeller outer circumference face is prevented from increasing, and consequently pump efficiency can be improved. Further, by causing the fuel pressure exerted upon the impeller outer circumference face to be uniform along the circumference direction thereof, the force operating upon the shaft causing the impeller to rotate is made uniform in the circumference direction, and partial abrasion of the bearing can be prevented.

Moreover, it is preferred that the groove located at the side opposite the discharge hole and sandwiching the impeller with the groove at the side of the discharge hole remains within the impeller outer circumference and does not pass through to the outer side of the impeller outer circumference.

Since the groove does not reach the impeller outer circumference, it is difficult for the pressurized fuel to pass through to the outer side of the impeller outer circumference face when the fuel is to be delivered to the discharge hole. Consequently the decrease in rotational efficiency of the impeller can be prevented, and the pulse noise generated by the fuel pump is more efficiently rendered quieter.

Furthermore, it is preferred that the groove located at the side opposite the discharge hole and sandwiching the impeller with the groove directly communicating with the discharge hole remains within an area corresponding to the group of concavities.

Since the groove remains within an area corresponding to the group of concavities formed in the impeller, the pressurized fuel is smoothly guided to the through—holes communicating between the groups of concavities when the fuel is to be delivered to the discharge hole, and it is made more difficult for the pressurized fuel to flow to the outer side of the impeller outer circumference face. Consequently, the decrease in rotational efficiency of the impeller can be prevented, and the pulse noise generated by the fuel pump is more efficiently rendered quieter.

It is preferred that the groove communicating directly with the discharge hole is displaced outwards in the radial direction in the vicinity of the lower flow end of this groove, and that the discharge hole is formed within an outer half area oft he group of concavities.

Displacing the groove outwards relative to the radial direction eliminates the phenomenon whereby the fuel is violently agitated in the vicinity of the discharge hole and thereby generates a great deal of noise. Consequently, the pump operating noise can be rendered quieter. Forming the discharge hole within an outer half area of the group of concavities allows the pressurized fuel to be pushed smoothly through the discharge hole, and consequently the pump operating noise is more efficiently rendered quieter.

PREFERRED EMBODIMENT OF THE INVENTION

In an embodiment of the fuel pump described below, a groove formed in a casing at a side opposite a discharge hole gradually grows shallower as it approaches a lower flow end of this groove. The groove formed at the same side of the discharge hole and communicating directly with the discharge hole gradually grows deeper as it approaches the lower flow end of this groove. The combination of shallower groove and the deeper groove provides with an improved pressurizing characteristics and quieter pump noise.

Figure 1:
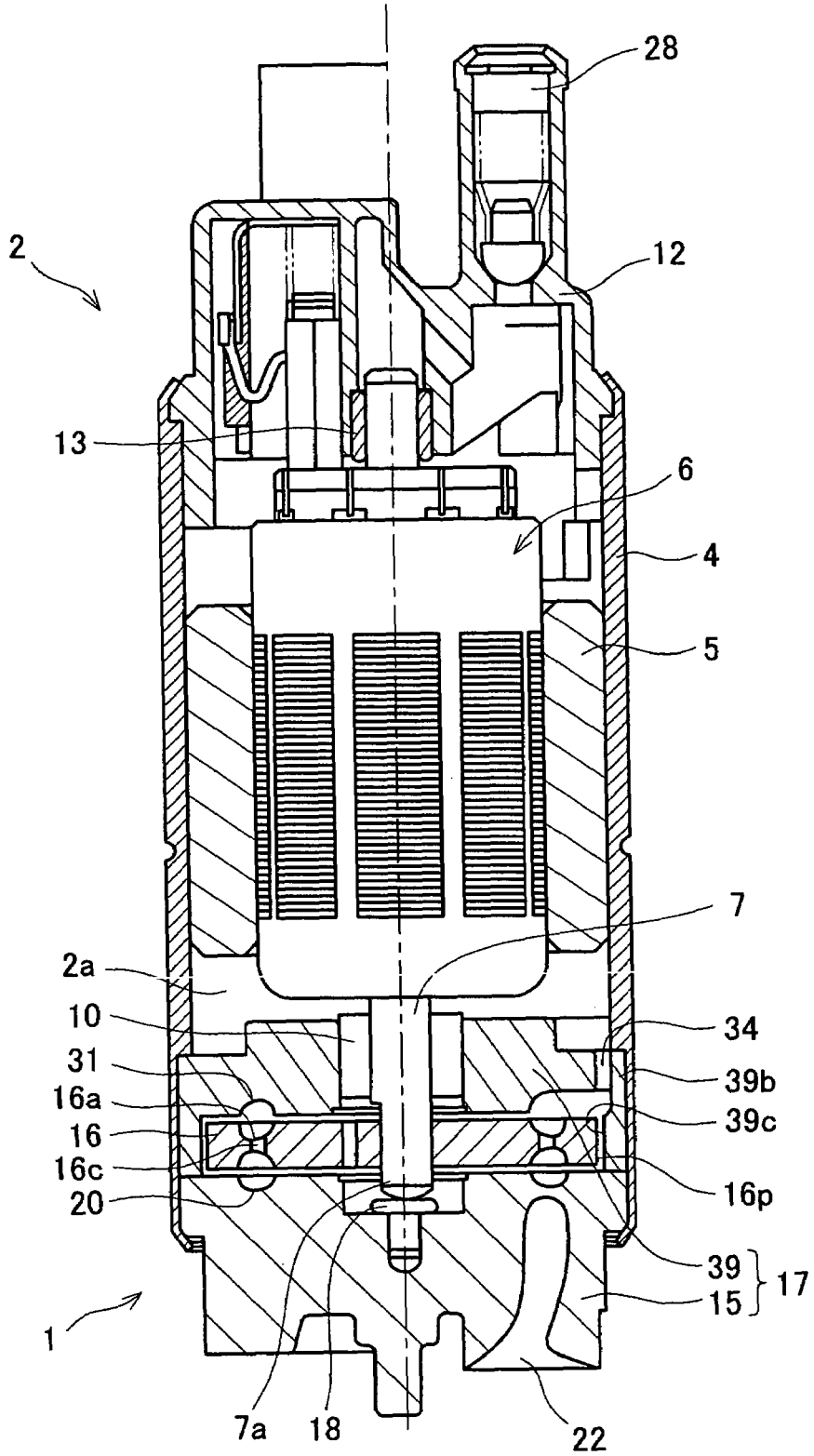
FIG. 1 shows a cross-sectional view of a fuel pump.
Figure 2:
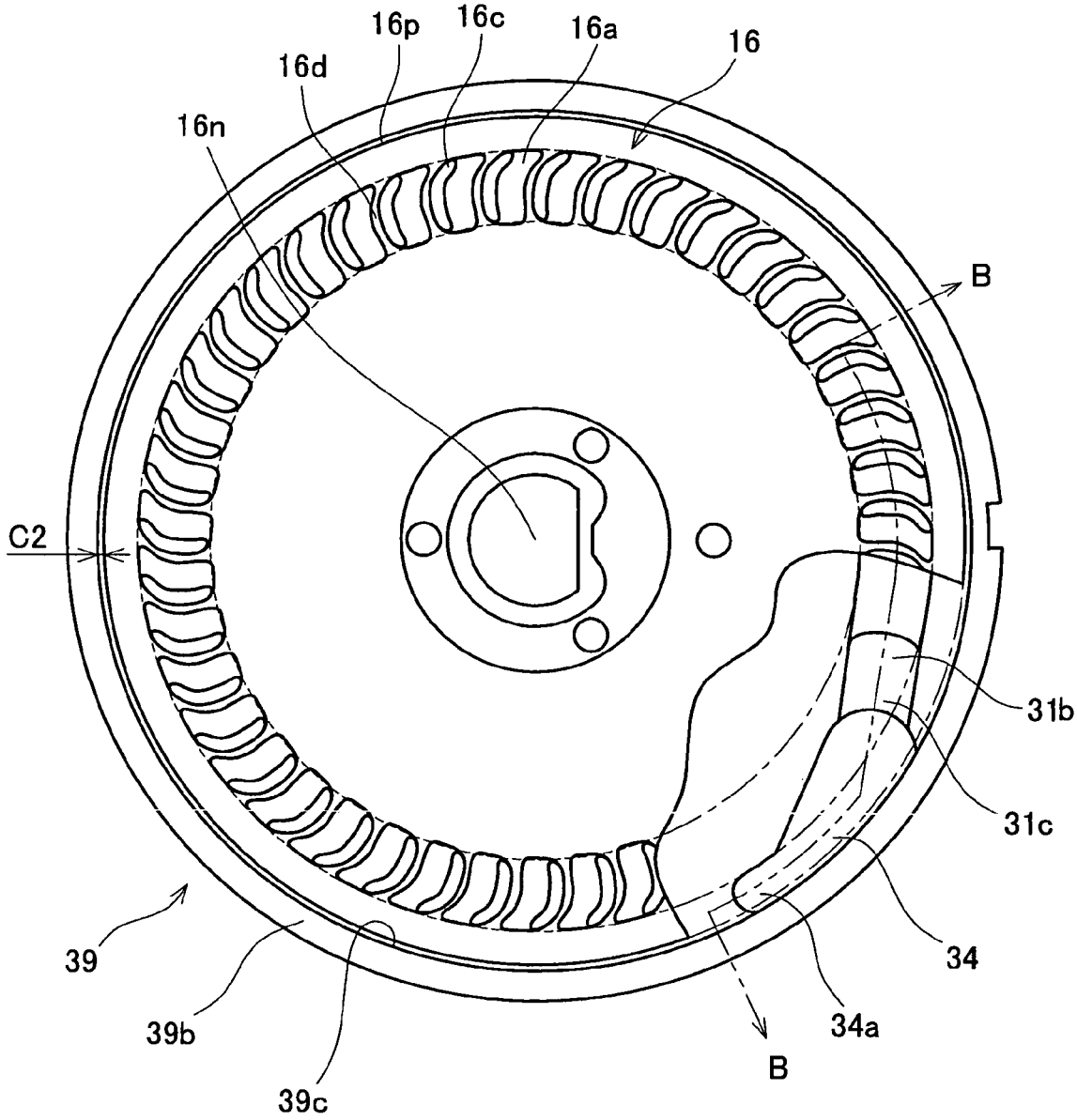
FIG. 2 shows a view of an impeller in a fitted state in a pump cover viewed from an inner side of a casing (in one part the impeller being shown by a broken line).
Figure 3:
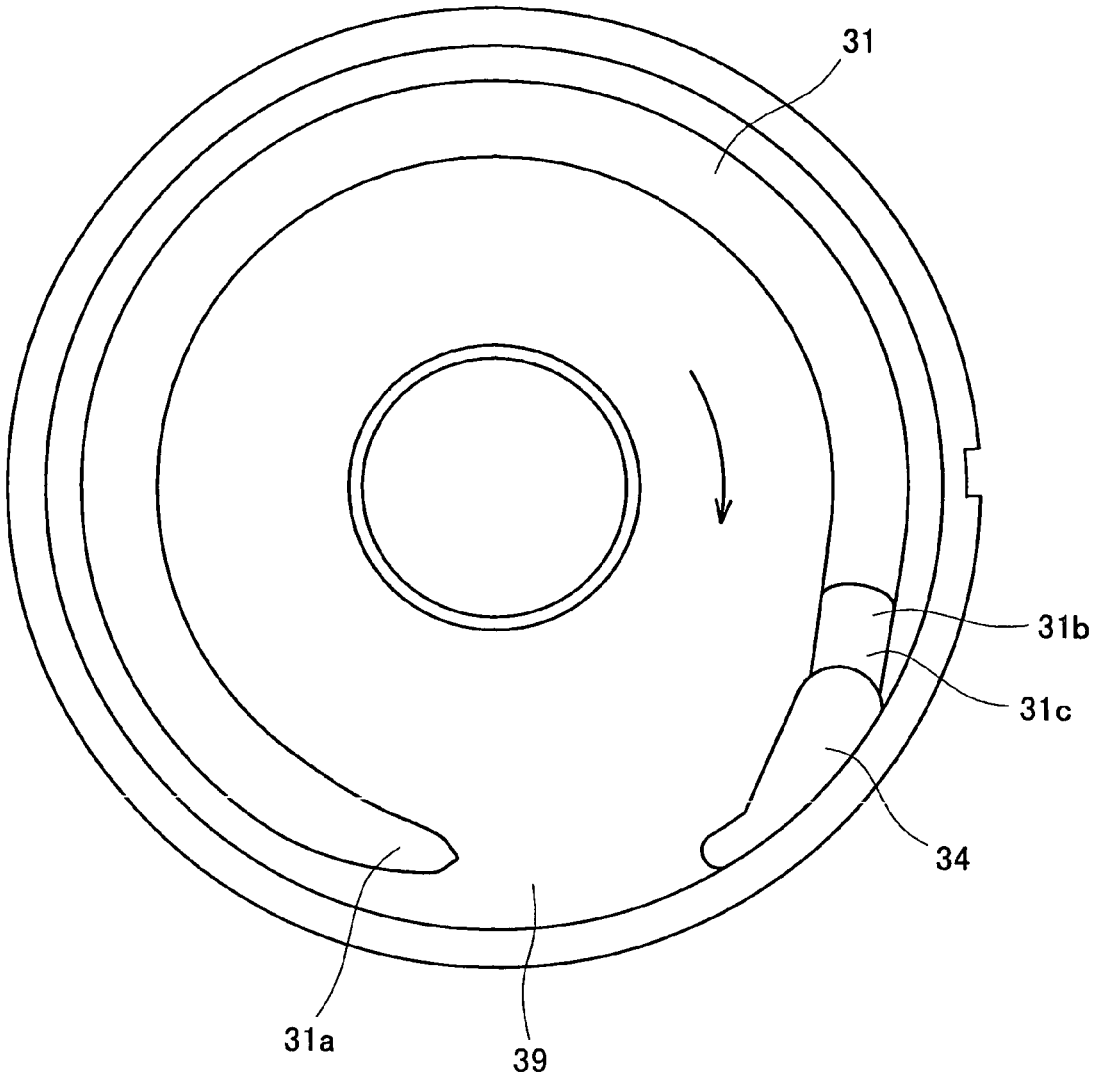
FIG. 3 shows a view of the pump cover viewed from the inner side of the casing.
Figure 4:
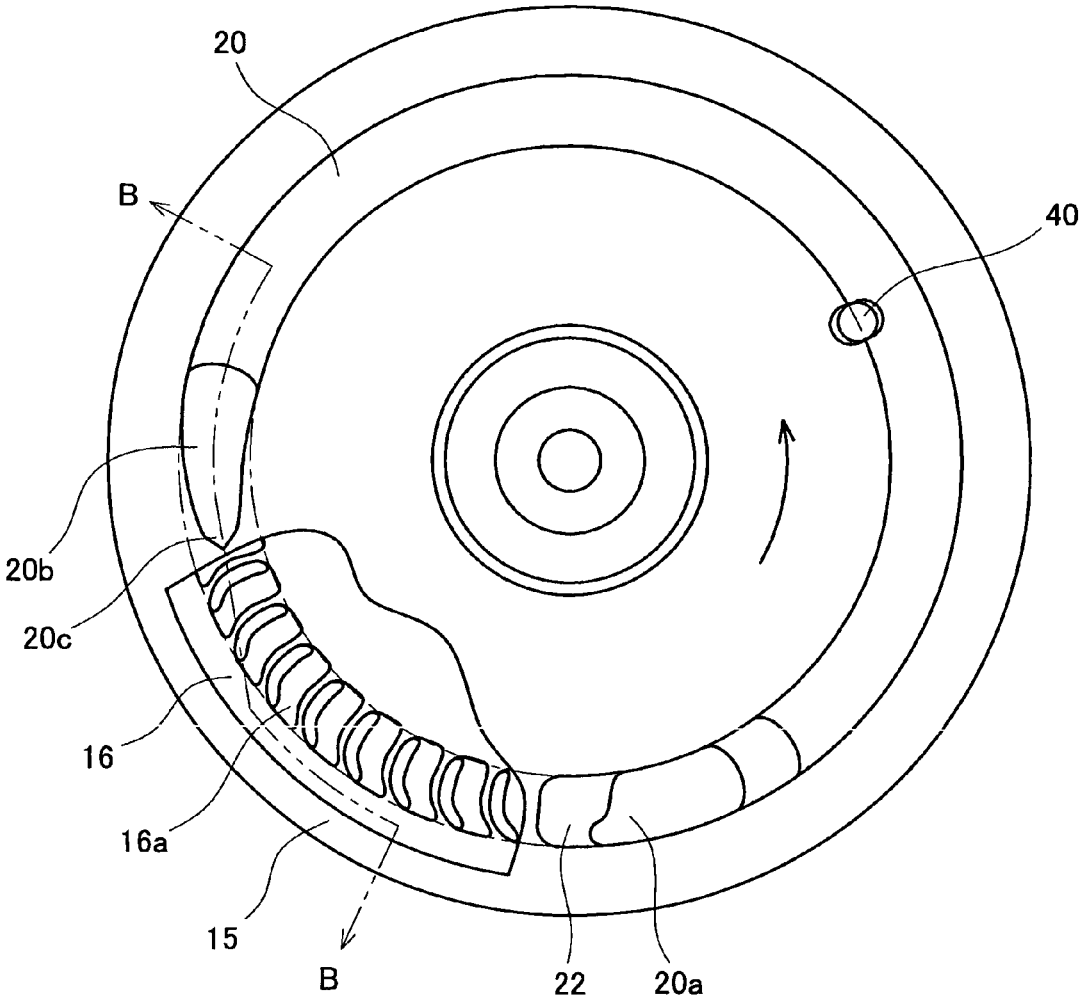
FIG. 4 shows a view of a pump body viewed from the inner side of the casing
Figure 5:
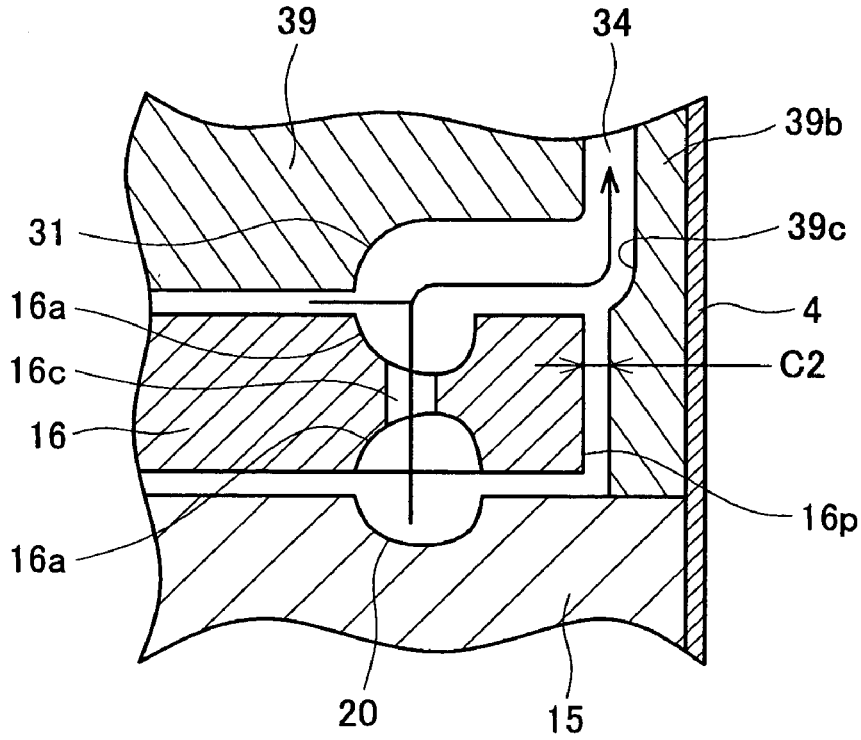
FIG. 5 schematically shows the flow of fuel.
Figure 6:
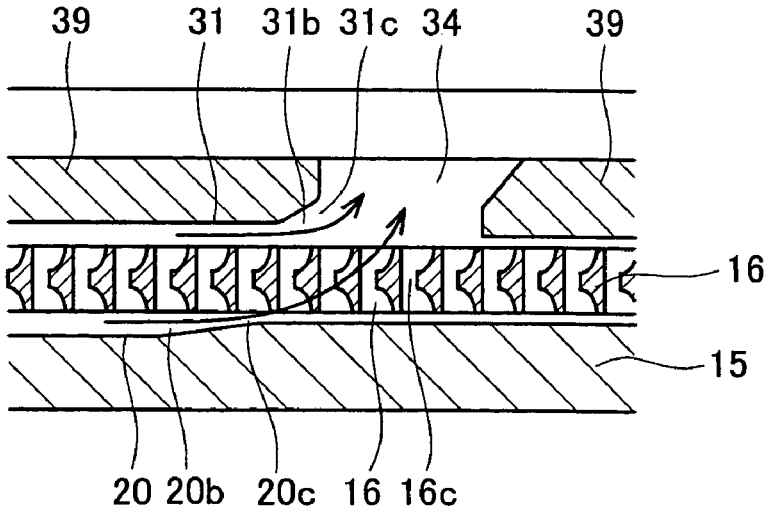
FIG. 6 shows a cross-sectional view of essential parts of the pump cover, the impeller, and the pump body.

An embodiment of the present invention is described referring to FIGS. 1 to 6. FIG. 1 is a cross-sectional view of the fuel pump of the present embodiment, FIG. 2 is a view of an impeller in a state whereby it has been fitted inside a pump cover, viewed from an inner side of a casing, FIG. 3 is a view of the pump cover viewed from the inner side of the casing, FIG. 4 is a view of a pump body viewed from the inner side of the casing (showing a portion of the fitted impeller), FIG. 5 is a view schematically showing the flow of fuel, and FIG. 6 is a cross-sectional view of essential parts of the pump cover, the impeller, and the pump body. Further, FIGS. 1 to 5 correspond respectively to FIGS. 10 to 14 used to describe the conventional example, identical numbers are assigned to components that the two have in common, and a description thereof is omitted.

The fuel pump of the present embodiment is a fuel pump used in a motor vehicle, the fuel pump being utilized within a fuel tank and being utilized for supplying fuel to the engine of the motor vehicle. As shown in FIG. 1, the fuel pump comprises a pump portion 1 and a motor portion 2 for driving pump portion 1. Motor portion 2 is composed of a direct current motor comprising a brush, a magnet 5 within an approximately cylindrical housing 4, and a rotating member 6 which is concentric with the magnet 5.

A lower portion of a shaft 7 of the rotating member 6 is rotatably supported, via a bearing 10, which is provided on a pump cover 39 attached to a lower end portion of the housing 4. Furthermore, an upper p portion of the shaft 7 is rotatably supported, via a bearing 13, which is provided on a motor cover 12 attached to an upper end portion of the housing 4.

The rotating member 6 is caused to rotate by means of conductively connecting a coil (not shown) of the rotating member 6 to an electric source via brushes and terminals (not shown) provided in the motor cover 12. The configuration of this type of motor portion 2 is known in the art and a detailed description thereof is omitted. Further, a motor of a type differing from the type shown here may also be utilized.

The configuration of pump portion 1 that is driven by motor portion 2 is described next. Pump portion 1 comprises pump cover 39, pump body 15, and impeller 16, etc. Pump cover 39 and pump body 15 are formed by, for example, die casting aluminum, and the two are fitted together to form casing 17 wherein impeller 16 is housed.

Impeller 16 is formed from resin. As shown in FIG. 2, impeller 16 is substantially disc shaped, and a group of concavities 16*a* is formed therein in an area extending inwards from impeller outer circumference face 16*p* by a specified distance, the group of concavities 16*a* being formed along a circumference direction thereof. Adjacent concavities 16*a* are separated by partition walls 16*d* that extend in a radial direction. The concavities 16*a* form the group of concavities 16*a* that are repeated in a circumference direction. The group of concavities 16*a* is formed in both upper and lower faces of impeller 16, and base portions of each of the upper and lower concavities 16*a* communicate via through-hole 16*c* (see FIG. 5).

An approximately D-shaped fitting hole 16*n* is formed in the center of impeller 16. A fitting shaft member 7*a*—this being D-shaped in cross-section—at the lower portion of shaft 7 fits into the fitting hole 16*n*. By this means, impeller 16 is connected with shaft 7 in a manner allowing follow-up rotation whereby slight movement in the axial direction is allowed. Outer circumference face 16*p* of impeller 16 is a circular face without irregularities.

As shown in FIGS. 1 and 3, groove 31 is formed in a lower face of pump cover 39 in an area facing the group of concavities 16*a* in the upper face of impeller 16, this groove 31 extending continuously in the direction of rotation of impeller 16 from upper flow end 31*a* to lower flow end 31*c*. A discharge hole 34 is formed in pump cover 39, this discharge hole 34 extending from lower flow end 31*c* of groove 31 to an upper face of pump cover 39. The discharge hole 34 passes through from the interior of casing 17 to the exterior of casing 17 (an inner space 2*a* of motor portion 2).

As shown in FIG. 2, inner circumference face 39*c* of circumference wall 39*b* of pump cover 39 faces impeller outer circumference face 16*p* with minute clearance C2 therebetween. Inner circumference face 39*c* extends along the entire circumference of pump cover 39 and entire impeller outer circumference face 16*p* including the vicinity of discharge hole 34. For the sake of clarity, the clearance C2 is represented as larger in the figure than it is in reality.

When clearance C2 is large, the pressurized fuel penetrates into clearance C2 and the pressure acting on impeller outer circumference face 16*p* is increased. The increased pressure acting on impeller outer circumference face 16*p* results in increased resistance against the rotation of impeller 16. The minute clearance C2 is selected to be a distance that the pressure acting on impeller outer circumference face 16*p* does not increase a predetermined pressure which causes a substantial drop of pump efficiency. The experiment made it clear that the substantial drop of pump efficiency can be avoided by decreasing the minute clearance C2 less than 200 μm. The minute clearance C2 is not required to be uniform along the entire circumference of pump cover 39 and entire impeller outer circumference face 16*p*. Especially the clearance C2 may be smaller at a region down stream side of discharge hole 34 and up stream side of intake hole 22 than at the rest.

The minute clearance C2 should be larger enough for preventing direct contact between impeller outer circumference face 16*p* and inner circumference face 39*c* of pump cover 39. The mass production must allow a certain tolerance of parts size. When the fuel pump is used for a long time, bearings 10 and 13 are worn and the rotating axis of shaft 17 is shift. The clearance C2 should be large enough for allowing production tolerance and change of rotating axis of impeller 16. The experiment made it clear that the clearance C2 larger than 100 μm is enough for this purpose. The minute clearance C2 should be large enough for preventing direct contact between impeller 16 and pump cover 39 and should be small enough for preventing substantial drop of pump efficiency. In this embodiment, the minute clearance C2 is selected between 100 to 200 μm.

Groove 31 of pump cover 39 has escape groove 31*b* located in the vicinity of lower flow end 31*c* thereof, escape groove 31*b* gradually growing deeper as it approaches discharge hole 34. Escape groove 31*b* directly communicates with discharge hole 34 at lower flow end 31*c* and is displaced towards the outer side of impeller 16 in the radial direction, but remains within the area surrounded by impeller outer circumference face 16*p*. As shown in FIG. 2, discharge hole 34 is not formed at an inner side of the region facing the group of concavities 16*a*. Instead, discharge hole 34 is formed at an outer side of the region facing the group of concavities 16*a* and further outwards area. When impeller 16 rotates, the fuel within concavity 16*a* flows out from concavity 16*a* at the outer side of concavity 16*a* due to centrifugal force, and fuel within groove 31 is drawn into concavity 16*a* at the inner side of concavity 16.

When discharge hole 34 is formed at outer side of the group of concavities 16*a*, the fuel that flows out from concavities 16*a* at the outer side of concavities 16*a* is smoothly introduced into discharge hole 34. When discharge hole 34 is not formed at inner side of the group of concavities 16*a*, the fuel within discharge hole 34 is not dawn into concavities 16*a* and reverse flow within discharge hole 34 is not caused. The fuel flow within discharge hole is smoothened and high pump efficiency can be obtained.

A part of discharge hole 34 at the lowest flow end extends at an area located outwardly from the group of concavities 16*a*. The part 34*a* of discharge hole 34 at the lowest flow end does not overlap with the group of concavities 16*a*. The part 34*a* of discharge hole 34 that does not overlap with the group of concavities 16*a* prevents fuels flowing out from concavities 16*a* from colliding with wall faces of pump cover 39 and reduces pump noise.

It is preferable to form discharge hole 34 within an area surrounded by impeller outer circumference face 16*d*, however, as shown in FIG. 2, discharge hole 34 may contact with inner circumferential face 39*c* of pump cover 39. In a later case, it becomes easier to produce discharge hole 34 accurately.

As shown in FIGS. 1 and 4, a groove 20 is formed in an upper face of pump body 15 in an area thereof opposite the group of concavities 16*a* in the lower face of impeller 16. Groove 20 extends continuously along the direction of rotation of impeller 16 (in FIGS. 3 and 4 the figures are viewed from a reverse direction and consequently the direction of rotation of the impeller is shown facing the reverse direction) from upper flow end 20*a* to lower flow end 20*c*. Intake hole 22 is formed in pump body 15, intake hole 22 extending from upper flow end 20*a* of groove 20 to a lower face of pump body 15. An escape groove 20*b* of groove 20 located in the vicinity of lower flow end 20*c* thereof gradually grows shallower as it approaches lower flow end 20*c*. Furthermore, escape groove 20*b* remains within an area opposite the group of concavities 16*a* of impeller 16.

A vapor jet 40 is formed at an inner side of groove 20 at a location slightly upstream from a center thereof. The vapor generated when pressure is reduced as the fuel is taken into groove 20 from intake hole 22 is discharged to the exterior of casing 17 via vapor jet 40.

Pump body 15, this being in a superposed state with pump cover 39, is attached by means of caulking or the like to the lower end portion of housing 4. A thrust bearing 18 is fixed to a central portion of pump body 15. The thrust load of shaft 7 is received by thrust bearing 18.

In FIG. 5, for the sake of clarity, each clearance is represented as larger than it is in reality. Groove 20 of pump body 15 is located at a side opposite the discharge hole 34, the impeller 16 being sandwiched between groove 31 located at the same side with discharge hole 34 and groove 20. Groove 20 does not communicate directly with discharge hole 34. Circumference wall 39*b* of pump cover 39 is adjacent to impeller outer circumference face 16*p* even at the location of discharge hole 34 (the clearance C2 is shown as larger in FIG. 5, whereas in fact it is extremely narrow), and groove 20 and discharge hole 34 do not actually communicate at the outer side of impeller outer circumference face 16*p*. Groove 20 and discharge hole 34 communicate only by means of through-holes 16*c* of impeller 16.

Groove 31 extending in the circumference direction of pump cover 39, and groove 20 extending in the circumference direction of pump body 15 extend along the direction of rotation of impeller 16, and extend from intake hole 22 to discharge hole 34. When impeller 16 rotates, the fuel within the fuel tank is drawn into casing 17 from intake hole 22. A portion of the fuel taken in from intake hole 22 flows along groove 20. The remaining portion of the fuel taken in from intake hole 22 passes through through-holes 16*c* of impeller 16, enters groove 31, and flows along groove 31. The pressure of the fuel rises as it flows along grooves 20 and 31. The fuel that has flowed along groove 31 and been pressurized is delivered from discharge hole 34 to motor portion 2. The fuel that has flowed along groove 20 and been pressurized passes through through-holes 16*c* of impeller 16 and merges with the fuel that was pressurized in groove 31. After merging, the fuel is delivered from discharge hole 34 to motor portion 2. The highly pressurized fuel delivered to motor portion 2 is delivered to the exterior of the pump from discharge port 28 (see FIG. 1).

The space between discharge hole 34 and intake hole 22, along the direction of rotation of impeller 16, does not have grooves 31 and 20 formed therein. FIG. 6 is a cross-sectional view along the line B—B of FIG. 2 and FIG. 4, impeller 16 rotating from left to right in this figure. Escape groove 20*b* of groove 20 of pump body 15 gradually grows shallower and closes as it approaches lower flow end 20*c*. Consequently, the fuel flowing along groove 20 is easily forced into the through-holes 16*c* of impeller 16. Further, escape groove 31*b* of groove 31 of pump cover 39 gradually grows deeper as it approaches lower flow end 31*c* and communicates with discharge hole 34. Consequently, the pressurized fuel is smoothly discharged from discharge hole 34, and the operating noise of the pump is rendered quieter. The clearance C2 between impeller outer circumference face 16*p* and pump cover inner circumference face 39*c* is extremely small along its entire circumference. Consequently, the pressurized fuel does not enter this clearance C2, and instead passes through through-holes 16*c* of impeller 16.

Figure 7:
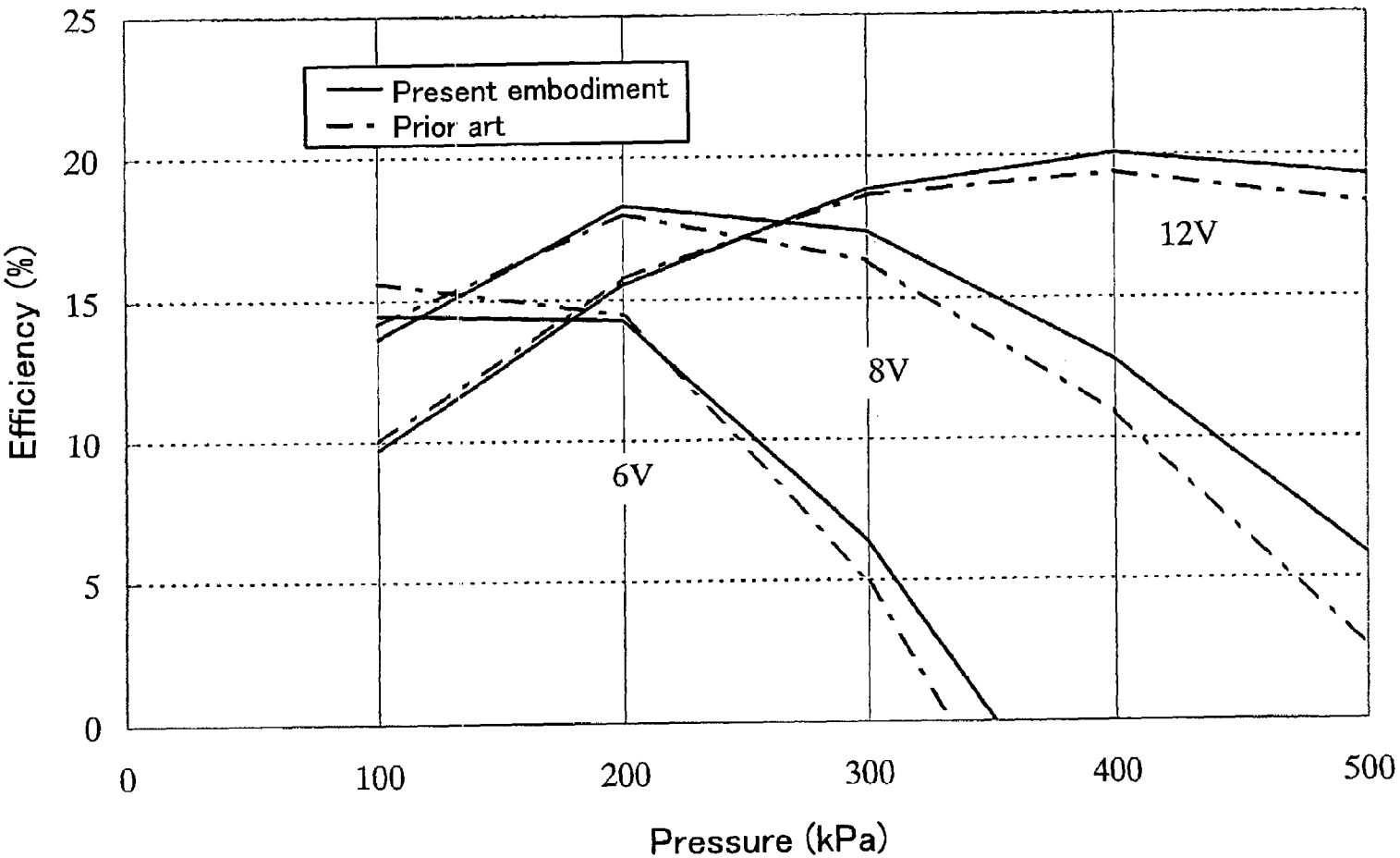
FIG. 7 shows a graph comparing the pump efficiency of a conventional fuel pump and the fuel pump of the present embodiment.

In the fuel pump of the present invention, the clearance between the impeller outer circumference face and the pump cover inner circumference face is extremely small along its entire circumference. Consequently, the increase of the fuel pressure exerted upon the impeller outer circumference face is prevented. As a result, the impeller rotates lightly and efficiently. Furthermore, the clearance between the impeller outer circumference face and the inner circumference face of the pump cover has the same dimensions along its entire circumference. Consequently, the impeller maintains its balance as it rotates, and the unbalanced load on the bearing is reduced. This further improves the rotational efficiency of the impeller. FIG. 7 is a graph comparing the pump efficiency of the conventional fuel pump and the fuel pump of the present embodiment. The graph shown by the dashed line represents the conventional fuel pump, and the graph shown by the solid line represents the fuel pump of the present embodiment. At voltages of 6V, 8V, and 12V, the pump efficiency of the fuel pump of the present embodiment is superior to that of the conventional fuel pump.

Figure 8:
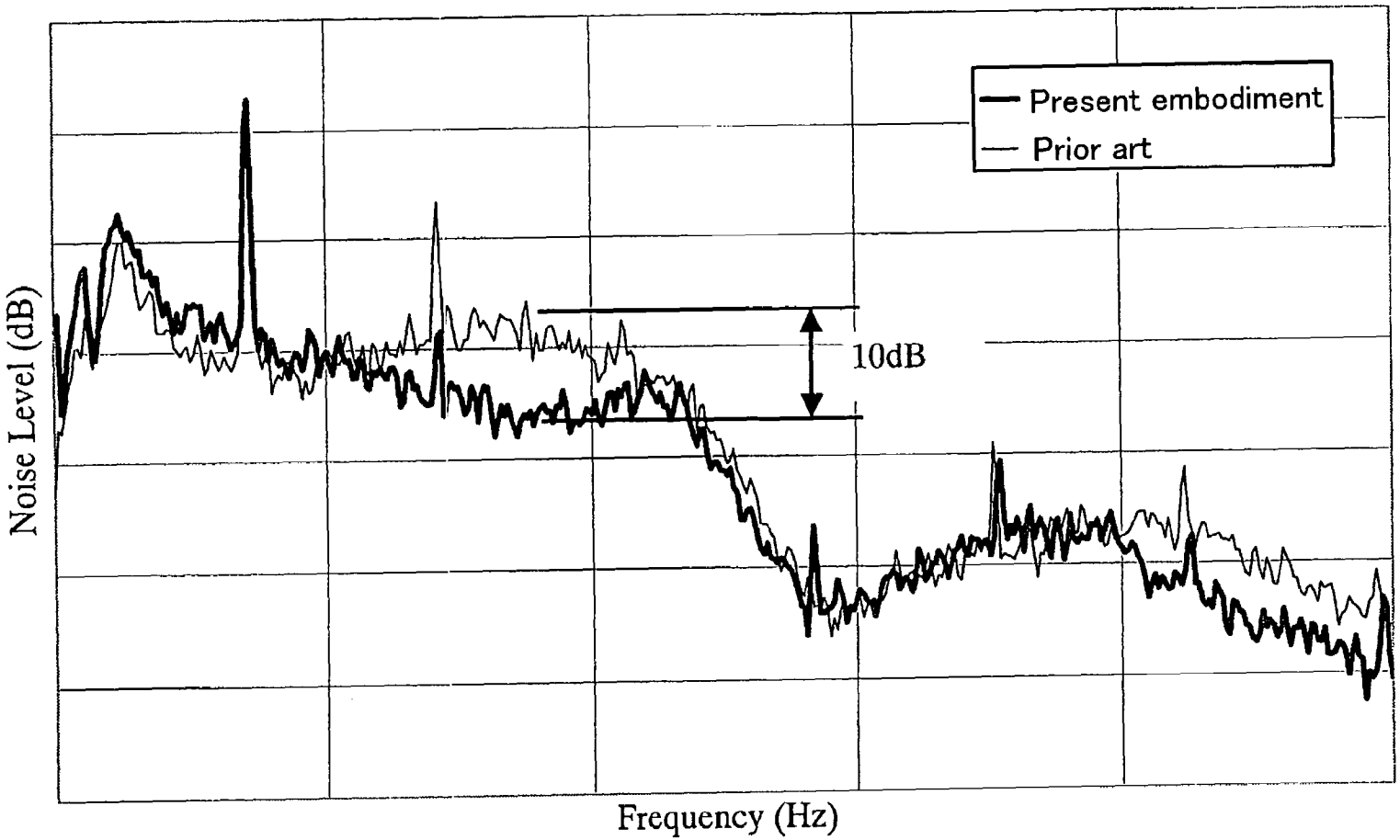
FIG. 8 shows a graph comparing the magnitude of pulse noise generated by the conventional fuel pump and by the fuel pump of the present embodiment.

The back flow of fuel that occurred in the conventional fuel pump (explained with reference to FIG. 14) has been removed in the fuel pump of the present embodiment. Consequently, the fuel pulse noise accompanying the back flow is reduced. FIG. 8 is a graph comparing the magnitude of the pulse noise generated by the conventional fuel pump and by the fuel pump of the present embodiment. The graph shown by the thin solid line represents the conventional fuel pump, and the graph shown by the thick solid line represents the fuel pump of the present embodiment. At every location where a difference appears, the noise of the conventional fuel pump is greater than that of the fuel pump of the present embodiment, a difference of 10 dB appearing at the spot where the greatest difference appears.

Figure 9:
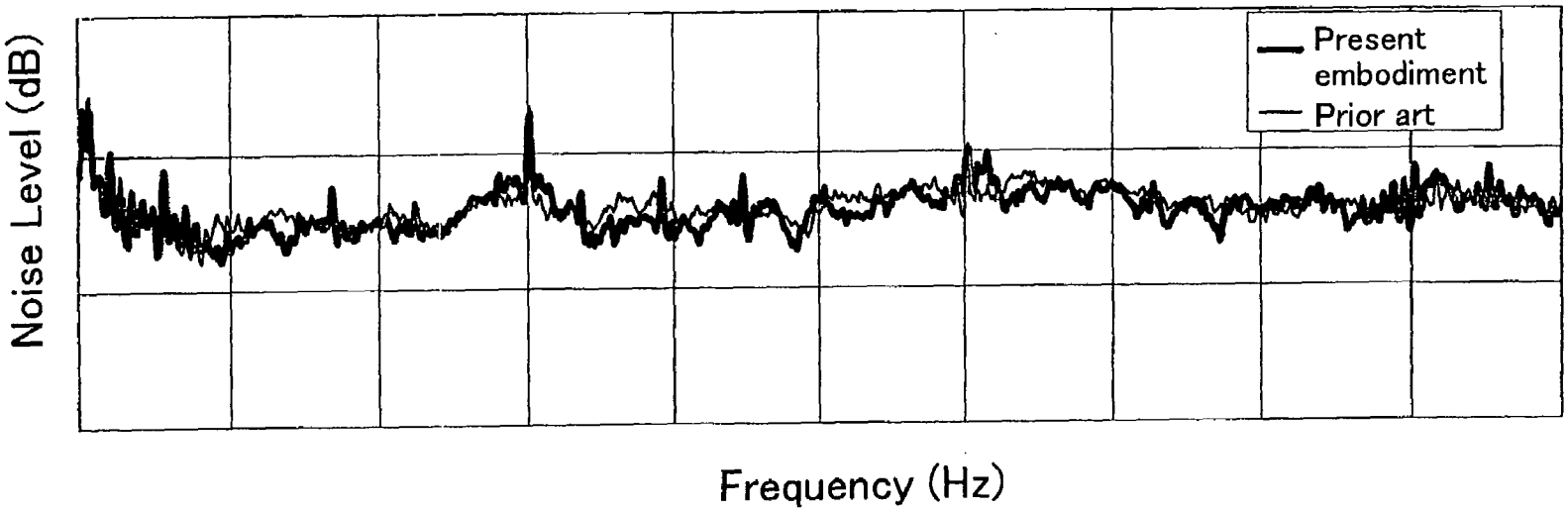
FIG. 9 shows a graph comparing the magnitude of high frequency noise generated by the conventional fuel pump and by the fuel pump of the present embodiment.
Figure 10:
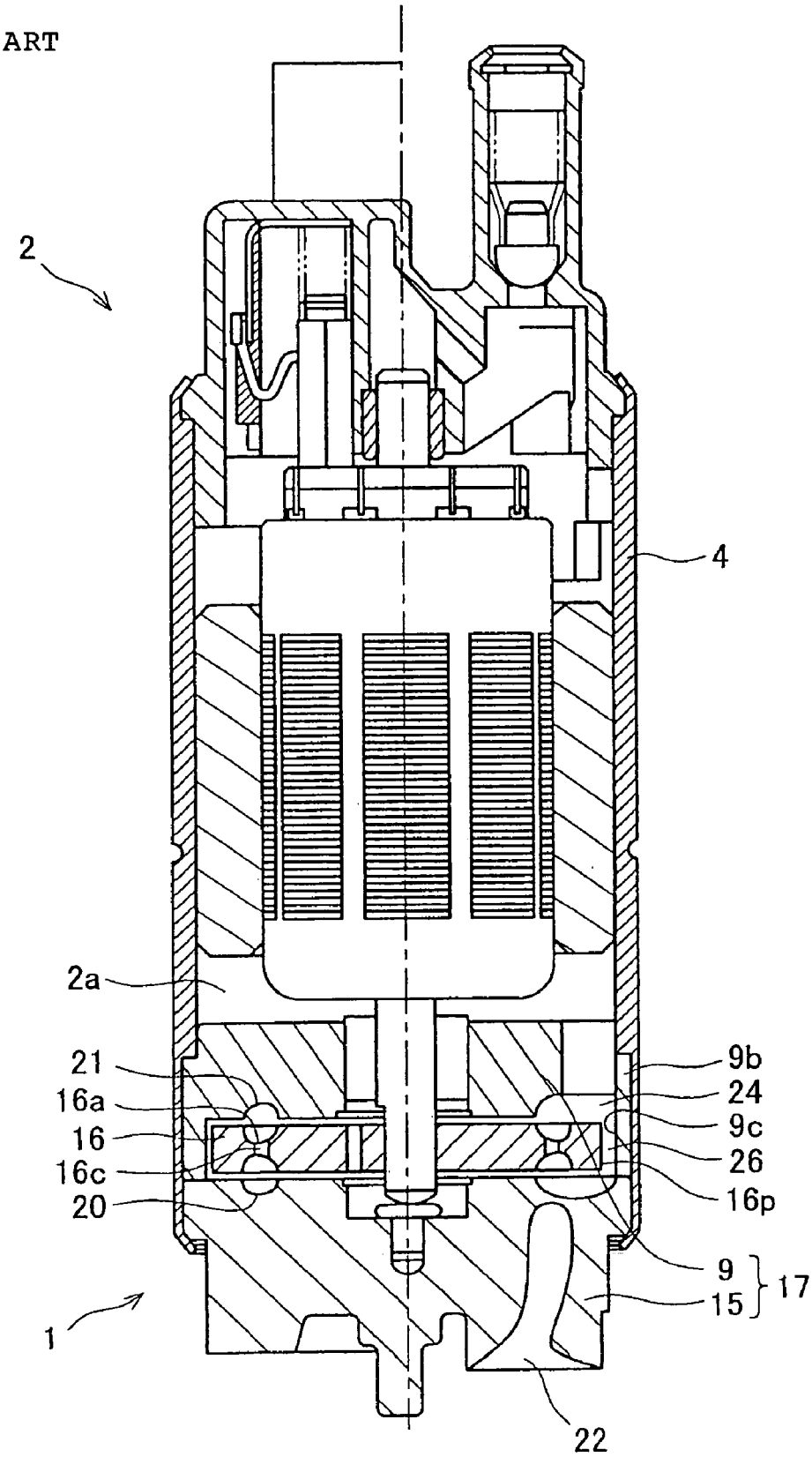
FIG. 10 PRIOR ART
FIG. 10 shows a cross-sectional view of a conventional fuel pump.
Figure 11:
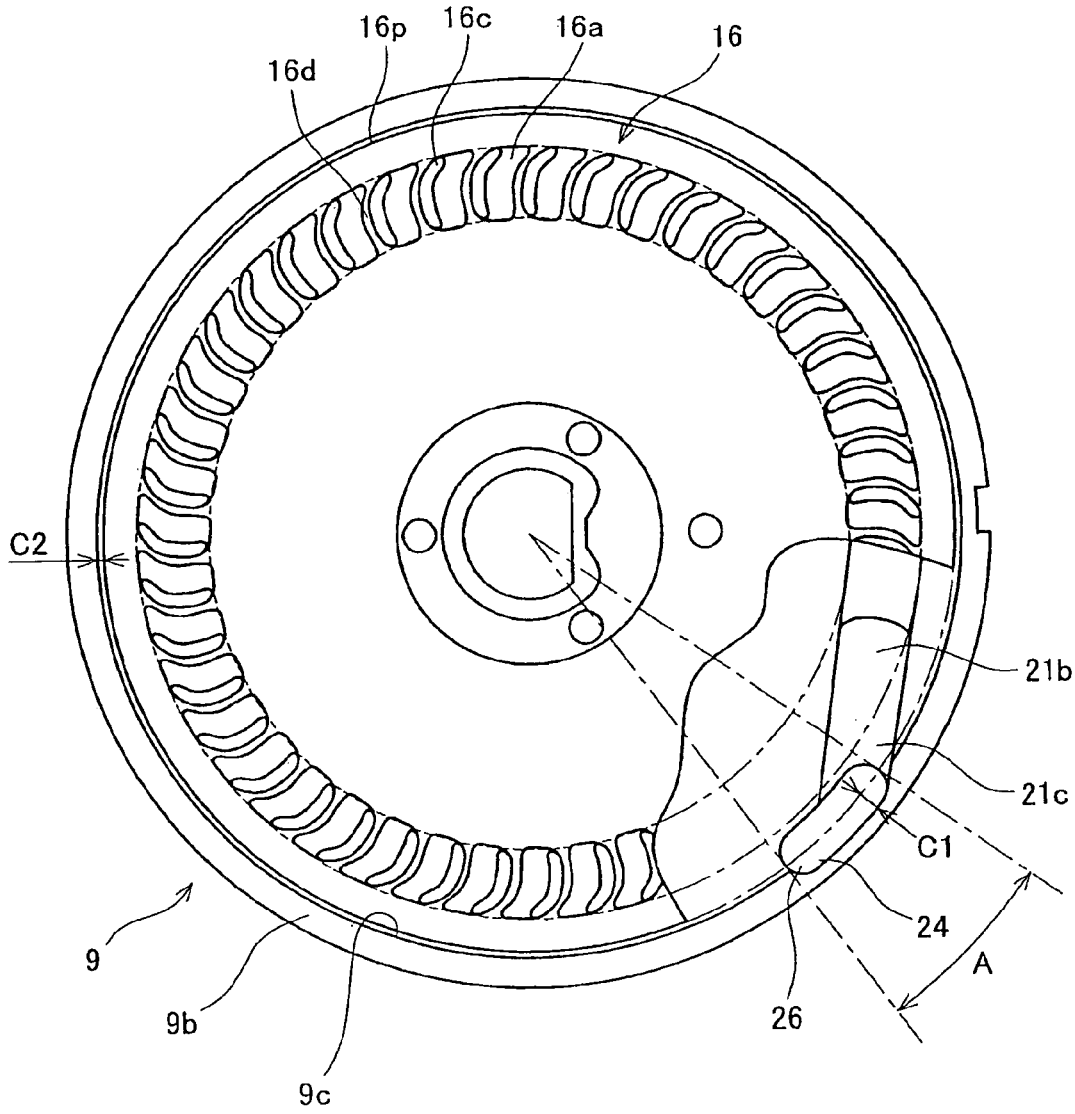
FIG. 11 PRIOR ART
FIG. 11 shows a view of an impeller in a fitted state in a pump cover viewed from an inner side of a casing (in one part the impeller being shown by a broken line).
Figure 12:
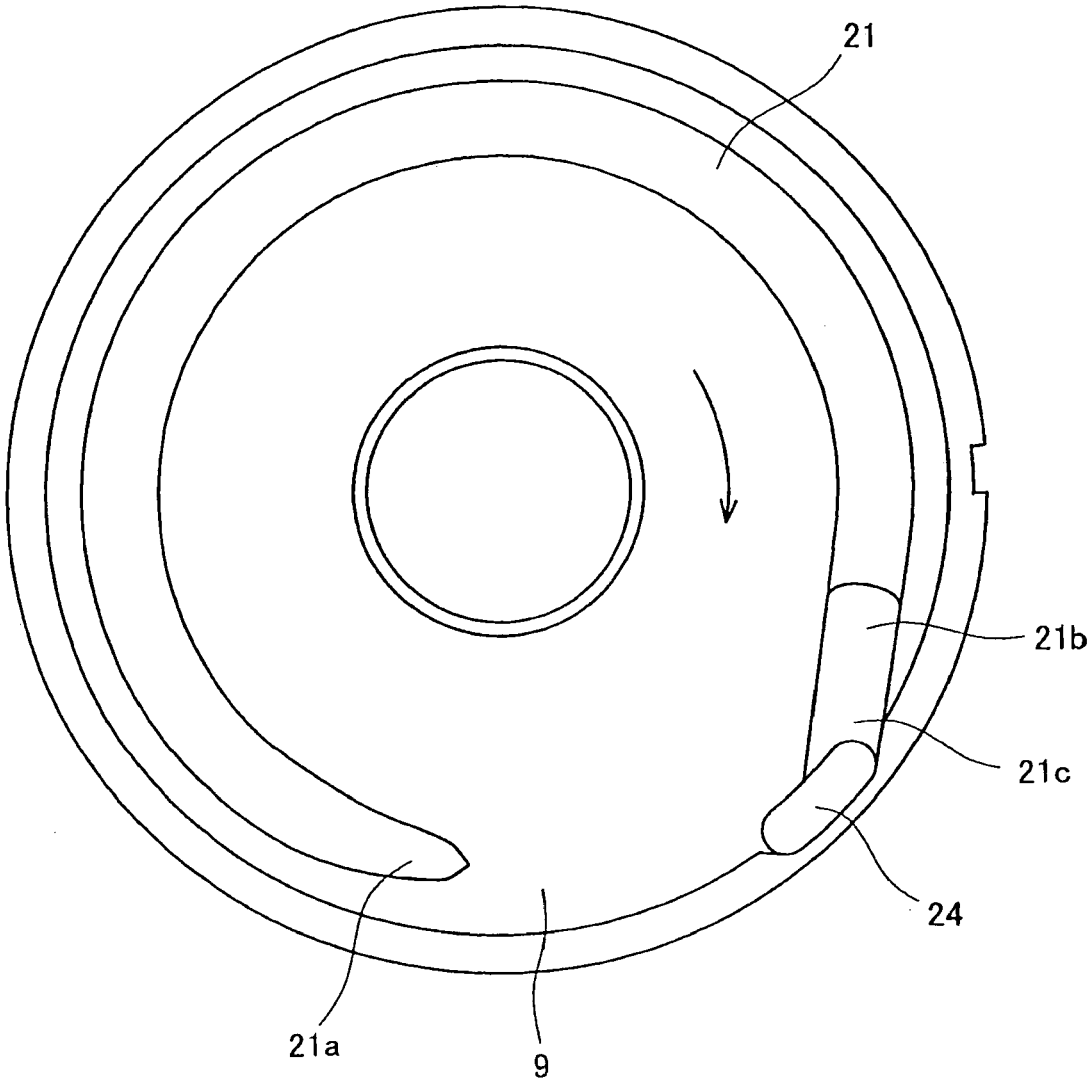
FIG. 12 PRIOR ART
FIG. 12 shows a view of the pump cover viewed from the inner side of the casing.
Figure 13:
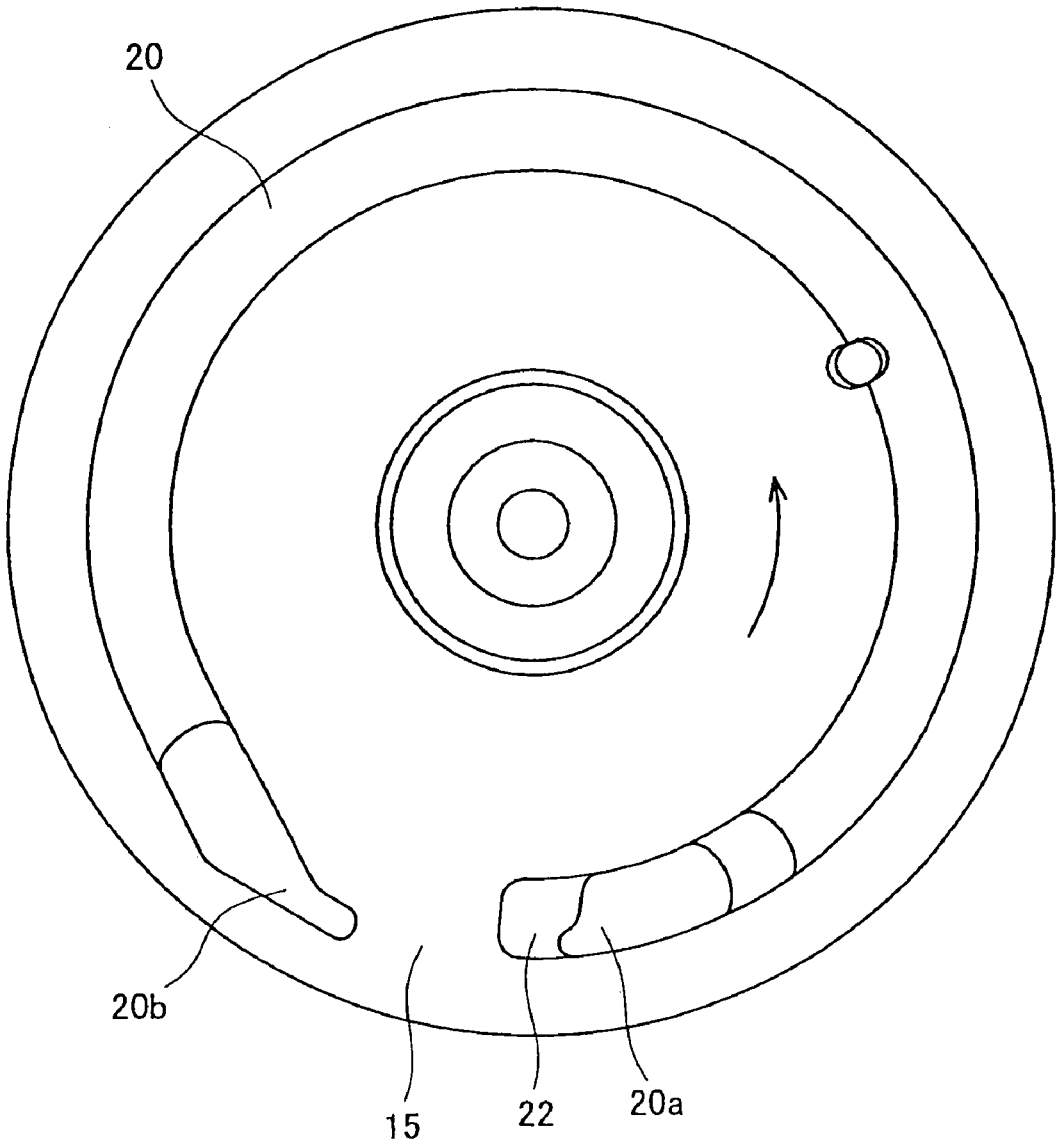
FIG. 13 PRIOR ART
FIG. 13 shows a view of a pump body viewed from the inner side of the casing.
Figure 14:
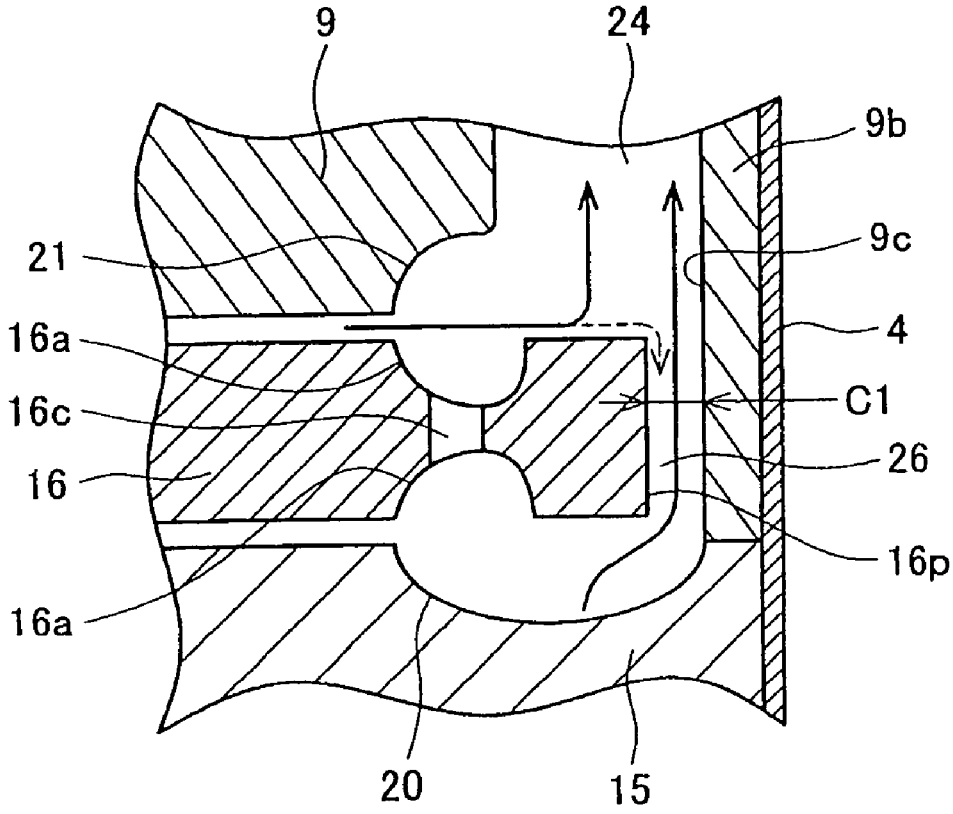
FIG. 14 PRIOR ART
FIG. 14 schematically shows the flow of fuel.

In the fuel pump of the present embodiment, escape grooves 20*b* and 31*b* are formed at the lower flow ends of fuel flow passage grooves 20 and 31, consequently the pressurized fuel is guided smoothly to discharge hole 34. FIG. 9 is a graph comparing the magnitude of the high frequency noise generated by the conventional fuel pump and by the fuel pump of the present embodiment. The graph shown by the thin solid line represents the conventional fuel pump, and the graph shown by the thick solid line represents the fuel pump of the present embodiment. The high frequency noise of the conventional fuel pump is greater than that of the fuel pump of the present embodiment.

A specific example of an embodiment of the present invention is presented above, but this merely illustrates some possibilities of the invention and does not restrict the claims thereof. The art set forth in the claims includes various transformations and modifications to the specific example set forth above.

Furthermore, the technical elements disclosed in the present specification or figures may be utilized separately or in all types of conjunctions and are not limited to the conjunctions set forth in the claims at the time of submission of the application. Furthermore, the art disclosed in the present specification or figures maybe utilized to simultaneously realize a plurality of aims or to realize one of these aims.

The invention claimed is:

1. A fuel pump comprising a casing and a substantially disc-shaped impeller rotating within the casing, wherein a group of concavities is formed in an upper face of the impeller, another group of concavities is formed in a lower face of the impeller, each group of concavities is formed in an area located inwardly from an impeller outer circumference face by a specified distance, concavities forming each group are repeated in a circumference direction of the impeller, a pair of adjacent concavities is separated by a partition wall extending in a radial direction of the impeller, and a pair of concavities in the upper and lower faces of the impeller is communicated, a pair of grooves is formed in a pair of inner faces of the casing, each groove extending continuously in a direction of rotation of the impeller from an upper flow end to a lower flow end in an area facing one of the groups of concavities, an intake hole and a discharge hole are formed in the casing, the intake hole passing from the exterior of the casing to the upper flow end of one of the grooves, and the discharge hole passing from the lower flow end of the other of the grooves to the exterior of the casing, an inner circumference face of the casing extends along the entire impeller outer circumference face including the vicinity of the discharge hole, the inner circumference face of the casing facing the impeller outer circumference face and being separated therefrom by a minute space, the groove directly communicating with the discharge hole is connected to the discharge hole via an escape groove extending obliquely radially outwardly in the direction of rotation of the impeller, wherein the escape groove does not protrude radially beyond the outer circumference face of the impeller; and the discharge hole contacts with the inner circumferential face of the casing and is not formed within an area located at an inner side of a region facing the group of concavities of the impeller.

2. A fuel pump as set forth in claim 1, wherein a part of the discharge hole at the lowest flow end extends at an area located radially outwardly from the group of concavities facing towards the discharge hole.

3. A fuel pump as set forth in claim 1, wherein the groove directly communicating with the discharge hole gradually grows deeper as it approaches the lower flow end thereof.

4. A fuel pump as set forth in claim 1, wherein the groove directly communicating with the intake hole remains within an area surrounded by the impeller outer circumference face and does not reach the impeller outer circumference face.

5. A fuel pump as set forth in claim 2, wherein the groove directly communicating with the intake hole remains within an area surrounded by the impeller outer circumference face and does not reach the impeller outer circumference face.

6. A fuel pump as set forth in claim 3, wherein the groove directly communicating with the intake hole remains within an area surrounded by the impeller outer circumference face and does not reach the impeller outer circumference face.

7. A fuel pump as set forth in claim 6, wherein the groove directly communicating with the intake hole remains within an area facing the group of concavities of the impeller.

8. A fuel pump as set forth in claim 7, wherein the groove directly communicating with the intake hole gradually grows shallower as it approaches the lower flow end thereof.

9. A fuel pump as set forth in claim 8, wherein the groove directly communicating with the intake hole communicates with the discharge hole by through-holes communicating the groups of concavities in the upper and lower faces of the impeller, and the groove directly communicating with the intake hole does not communicate with the discharge hole through the outer side of the impeller outer circumference face.

* * * * *